US007654187B2

(12) United States Patent
Hochstrate et al.

(10) Patent No.: US 7,654,187 B2
(45) Date of Patent: Feb. 2, 2010

(54) FIREARM FIRE CONTROL SELECTOR

(75) Inventors: Paul M. Hochstrate, Plantsville, CT (US); Michael F. LaPlante, Chicopee, MA (US)

(73) Assignee: Colt Defense LLC, Hartford, CT (US)

( * ) Notice: Subject to any disclaimer, the term of this patent is extended or adjusted under 35 U.S.C. 154(b) by 286 days.

(21) Appl. No.: 10/836,443

(22) Filed: Apr. 30, 2004

(65) Prior Publication Data

US 2005/0241470 A1 Nov. 3, 2005

(51) Int. Cl.
*F41A 5/00* (2006.01)

(52) U.S. Cl. ..... 89/142; 89/139; 89/144

(58) Field of Classification Search ..... 89/144, 89/139, 142, 148–150
See application file for complete search history.

(56) References Cited

U.S. PATENT DOCUMENTS 2,379,461 A * 7/1945 Simpson ..... 89/130
2,533,283 A * 12/1950 Pierce ..... 89/142
4,433,610 A * 2/1984 Tatro ..... 89/148
5,251,533 A * 10/1993 Layton ..... 89/142
5,426,881 A * 6/1995 Ruger ..... 42/70.08
5,623,114 A * 4/1997 Soper ..... 89/141
5,736,667 A * 4/1998 Munostes et al. ..... 89/132
5,760,328 A * 6/1998 Robbins ..... 89/129.02
5,881,485 A * 3/1999 Milazzo ..... 42/70.08
6,125,735 A * 10/2000 Guhring ..... 89/141

* cited by examiner

*Primary Examiner*—M. Clement
(74) *Attorney, Agent, or Firm*—Perman & Green, LLP

(57) ABSTRACT

An automatic firearm capable of automatic or semiautomatic fire. The firearm has a receiver having a moveable hammer. A selector is rotatably mounted in the receiver. A first sear is rotatably mounted in the receiver to engage the hammer where the first sear contacts a first camming surface of the selector. A second sear is rotatably mounted in the receiver to engage the hammer where the second sear contacts a second camming surface of the selector. A disconnect is rotatably mounted in the receiver where the disconnect contacts a third camming surface of the selector. The selector has a number of selectable positions disposed so that rotation of the selector between a first and last selectable position of the number of selectable positions is less than 180 degrees.

19 Claims, 10 Drawing Sheets

FIREARM FIRE CONTROL SELECTOR

BACKGROUND

1. Field of the Invention

The present invention relates to a firearm and, more particularly, to a firearm having a fire control selector.

2. Description of Earlier Related Developments

Automatic and semiautomatic firearms may be provided with a fire control selector enabling the user to switch between modes of fire, such as for example, safe semi automatic, burst and/or automatic. For example, U.S. Pat. Nos. 5,760,328 and 4,433,610, which are incorporated herein by reference in their entirety; disclose M4 type firearms, each having a fire control selector protruding from the receiver of the firearm. Here, the user rotates the fire control selector with a thumb or other finger(s) to switch between firearm modes of operation. A problem arises when a user has difficulty with the range of motion required to switch the selector from one mode to another. Another problem arises when a user would like to change the fire selector mode more quickly without having to go through such an extensive range of motion. Another problem arises when a user would like to switch hands of operation of the firearm. Accordingly, there is a desire to provide a firearm control selector requiring less range of motion between modes that enables ambidextrous operation.

SUMMARY OF THE EMBODIMENTS

In accordance with one exemplary-embodiment, an automatic firearm capable of automatic or semiautomatic fire is provided. The firearm has a receiver having a moveable hammer located therein. A selector is rotatably mounted in the receiver. A first sear is provided rotatably mounted in the receiver to engage the hammer, with the first sear contacting a first camming surface of the selector. A second sear is provided rotatably mounted in the receiver to engage the hammer with the second sear contacting a second camming surface of the selector. A disconnect is provided rotatably mounted in the receiver with the disconnect contacting a third camming surface of the selector. The selector has a number of selectable positions disposed so that rotation of the selector between a first and last selectable position of the number of selectable positions is less than 180 degrees.

In accordance with another exemplary embodiment, a fire control selector for an automatic firearm is provided. The fire control selector has an automatic sear camming surface and a trigger camming surface disposed adjacent the automatic sear camming surface. A disconnect camming surface is disposed adjacent the trigger camming surface. The automatic sear camming surface, the trigger camming surface and the disconnect camming surface are provided arranged so that, when the selector is installed in a firearm receiver, the automatic sear camming surface, the trigger camming surface and the disconnect camming surface respectively engage an automatic sear, a trigger and a disconnect of the firearm to select a firearm operation mode. Rotation of the fire control selector between a selectable end position, from selectable positions of the fire control selector and another selectable end position position is less than 180 degrees.

In accordance with another exemplary embodiment, an ambidextrous selector assembly is provided. The ambidextrous selector assembly is adapted to be rotatably mounted in a receiver of an automatic firearm, with the receiver having first and second opposing sides. The ambidextrous selector assembly has a first fire control selector having a switch handle, a selector cam, a coupling feature and at least one recess adapted to be engaged by a moveable plunger of the firearm for holding the first fire control selector in a selectable position. A second fire control selector is provided having a switch handle, a mating feature and a slot. The mating feature in the second fire control selector engages the coupling feature of the first fire control selector. When mounted to the receiver, the first fire control selector protrudes from the first side of the receiver and the second fire control selector protrudes from the second side of the receiver. The plunger engages the at least one recess through the slot.

In accordance with another exemplary embodiment, a M4 automatic firearm is provided. The M4 automatic firearm has a receiver with an automatic sear, a trigger and disconnector operably mounted in a receiver housing to control hammer operation in effecting different modes of firearm operation. A mode selector is provided pivotally mounted to the receiver having a number of selectable positions for selecting a different one of the modes of operation. The mode selector is provided with an indexer stably holding the mode selector in each of the selectable positions with the indexer having indexing positions corresponding to the selectable positions and being located so that selector rotation between an end one of the selectable positions and another end one of the selectable positions is less than about 180 degrees.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
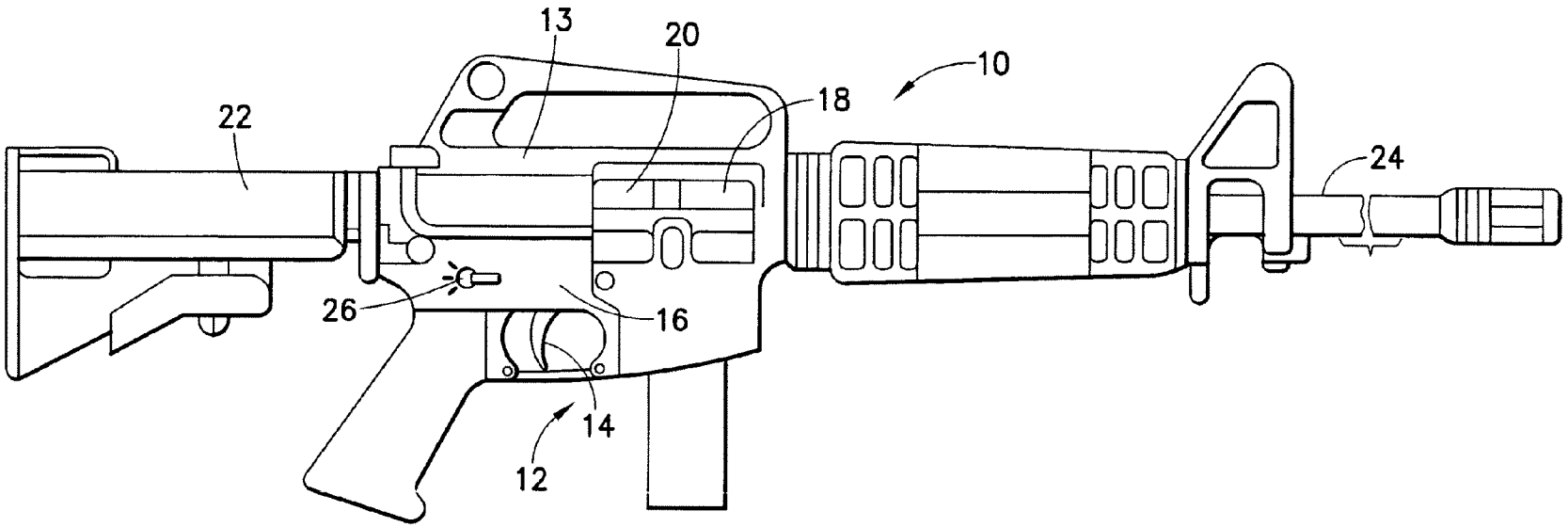
FIG. 1 is a side elevation view of an automatic firearm incorporating features in accordance with an exemplary embodiment.

Referring to FIG. 1, there is shown, a side elevation view of an automatic firearm 10 capable of automatic or semiautomatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

Firearm 10 may be gas operated, like examples, such as the M4 or M16 type. Firearm 10 incorporates a firing mechanism according to the present invention. The firearm 10 and its sections described in greater detail below is merely exemplary, and in alternate embodiments the firearm 10 may have other sections, portions or systems. A receiver, generally shown at 12, includes upper receiver section 13 and a lower receiver section 16. Firearm 10 also has a trigger 14, and a fire control selector or switch 26. The receiver 12 has a chamber 18 for receiving a bolt assembly 20. The rear portion of the chamber 18 may be defined by a usual receiver extension located in the stock 22 for receiving a buffer and operating spring. Connected to the forward portion of the chamber 18 is a barrel 24 having a cartridge chamber in which a cartridge may be positioned.

Figure 2:
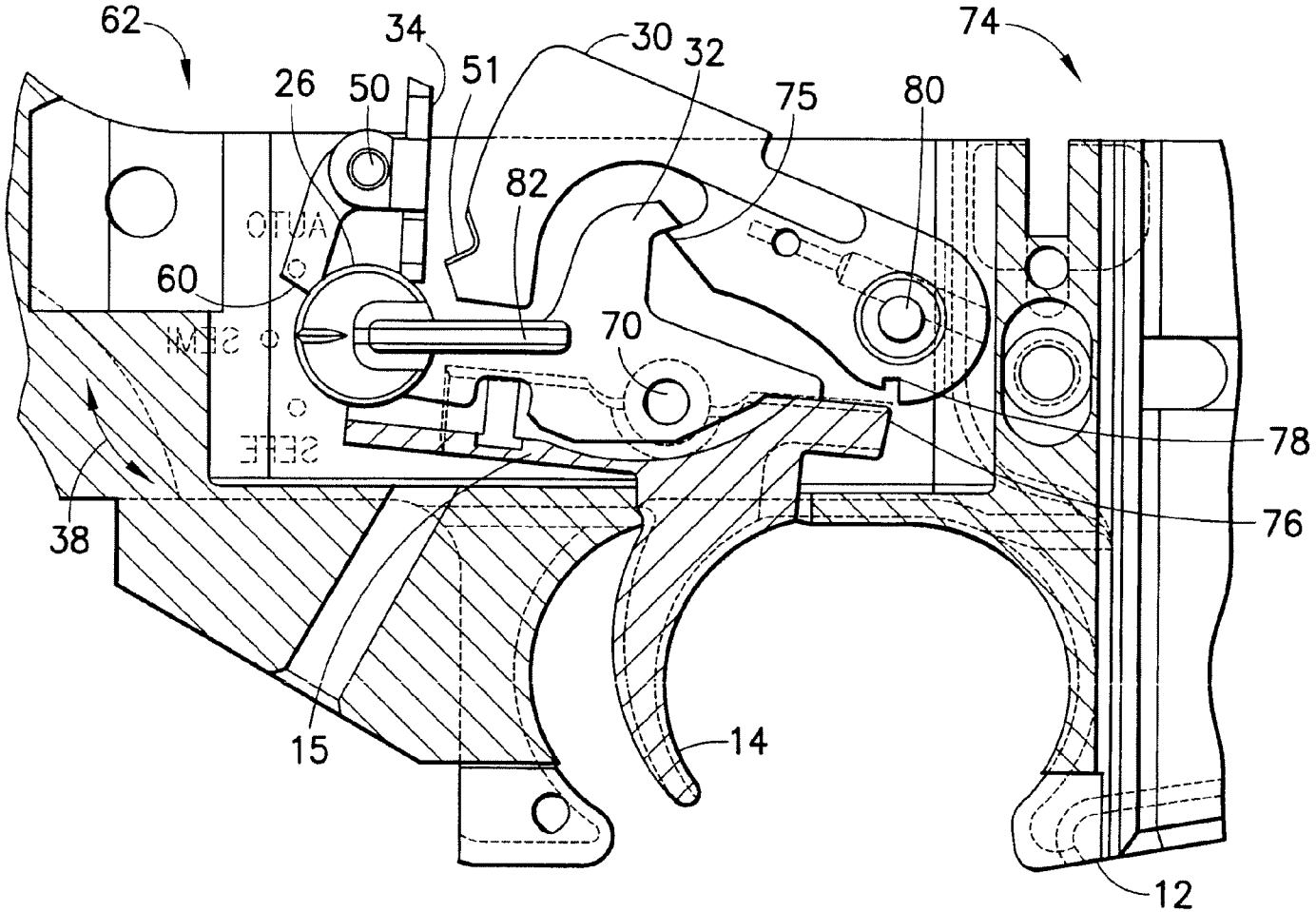
FIG. 2 is a partial side elevation view, partially in section of the receiver section of the firearm shown in FIG. 1.
Figure 3:
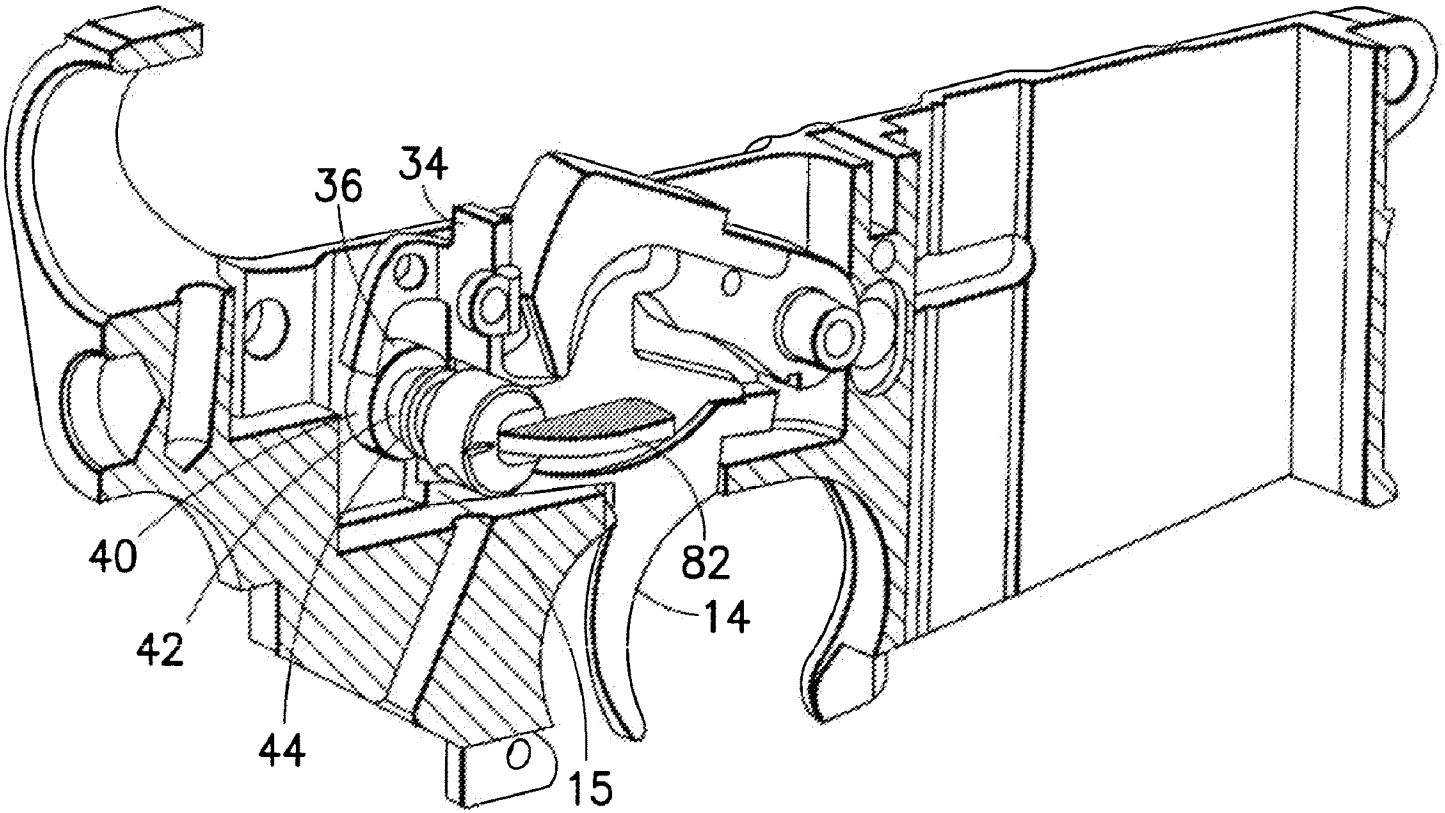
FIG. 3 is a partial isometric view partially in section of the receiver section of the firearm shown in FIG. 1.
Figure 4:
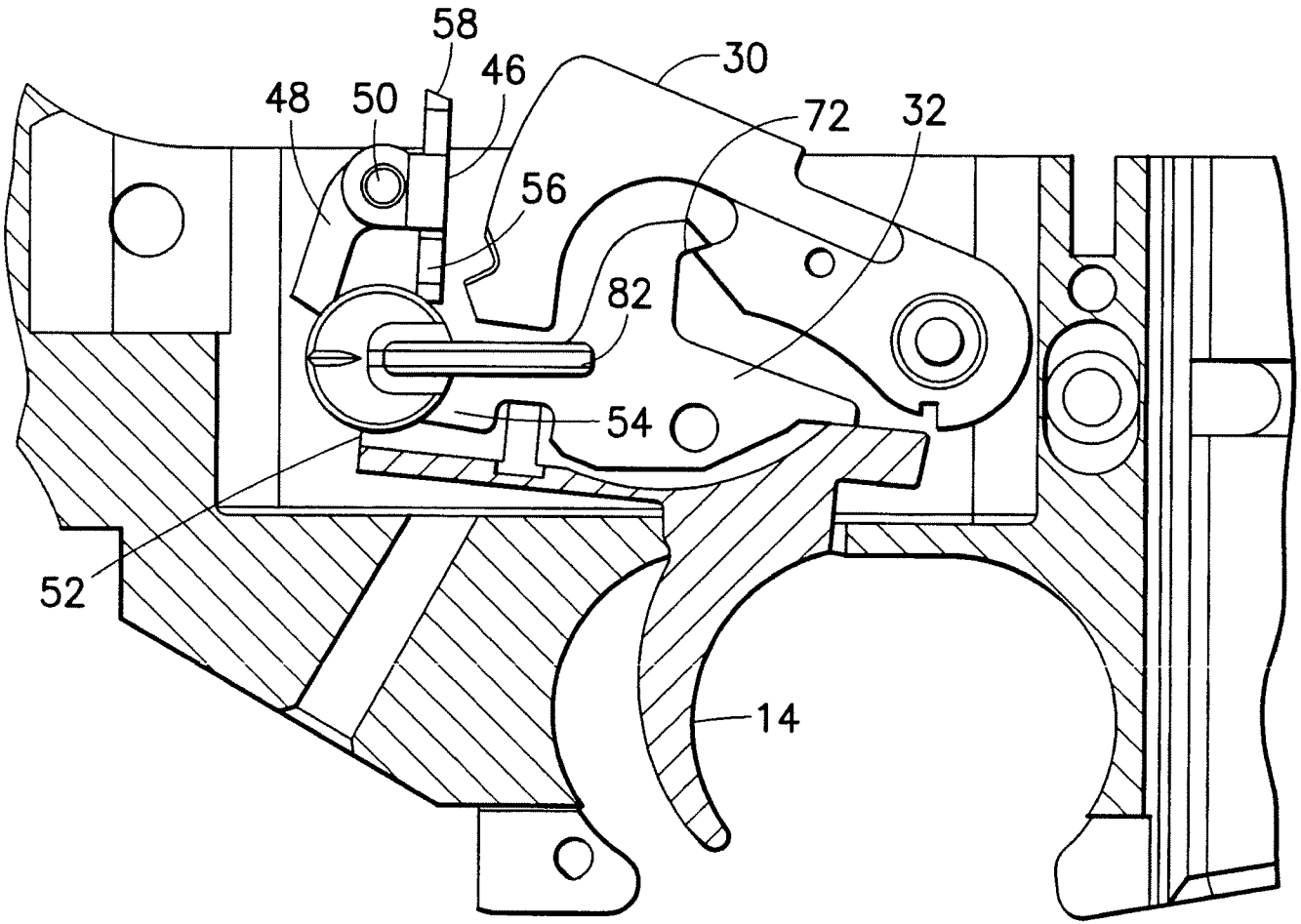
FIG. 4 is another partial side elevation view, partially in section of the receiver section of the firearm shown in FIG. 1.
Figure 5:
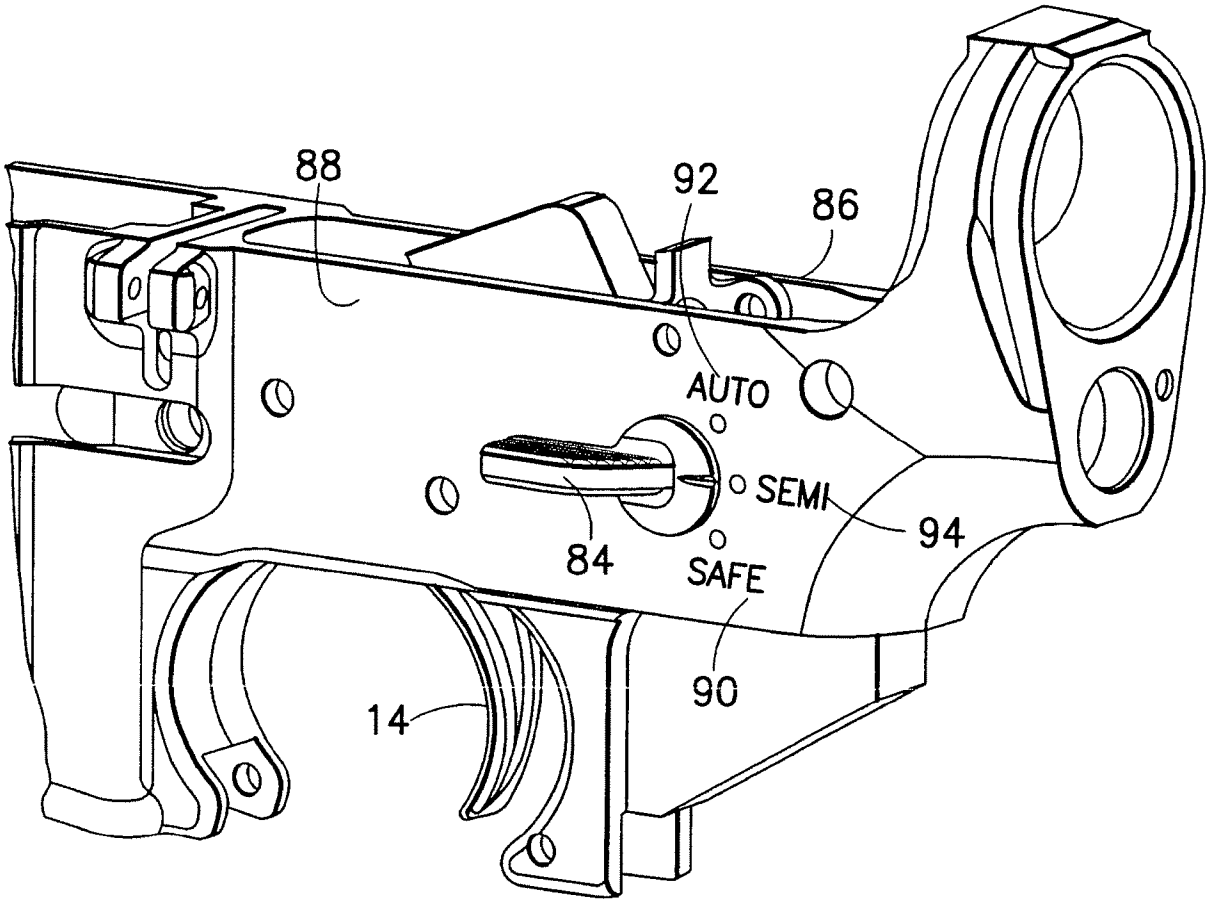
FIG. 5 is a partial isometric view of an opposing side of the receiver section of the firearm shown in FIG. 1.

Referring to FIGS. 2 and 4, there is shown a partial side elevation view, partially in section of the receiver section of the firearm shown in FIG. 1. Referring also to FIG. 3, there is shown a partial isometric view partially in section of the receiver section of the firearm shown in FIG. 1. Referring further to FIG. 5, there is shown a partial isometric view of an opposing side of the receiver section of the firearm shown in FIG. 1. In addition to trigger 14, firearm 10 has a hammer 30, a semi-automatic disconnector 32, and an automatic sear 34. The hammer is rotatably movable on pin 80. A fire control selector 26 is rotatably mounted in the receiver 12. The fire control selector 26 is connected to a rotatable firing control cam 36 (see FIG. 3). Cam 36 may be axially rotated (in directions 38) shown in FIG. 2) for selecting among types of firing selections of the firearm. Fire control selector 26 can be axially-rotated from "SAFE" to "SEMI" to "FULL AUTO", and in reverse. Sear 34 is provided rotatably mounted in the receiver 12 to engage the hammer 30, with sear 34 contacting a first camming surface of the fire control selector 26. A second sear 15 (see also FIG. 2) is provided formed with trigger 14 and rotatably mounted in the receiver to engage the hammer 30 with the second sear 15 contacting a second camming surface of the fire control selector 26. Disconnect. 32 is provided rotatably mounted in the receiver with the disconnect contacting a third camming surface of the selector 26. The control cam 36 has a first section 40 for interacting with the automatic sear 34, a second section 42 for interacting with the rear end 52 of the trigger 14, and a third section 44 for interacting with the rear end 54 of the semi-automatic disconnector 32. The first sear 34 may be an automatic sear. The sear 52 on the trigger may be a main sear. The auto sear 34, trigger and disconnect 32 of the embodiment illustrated in FIGS. 1-3 may be arranged in the configuration used in an M4 firearm. In alternate embodiments, the auto sear, hammer and disconnect may have any other suitable configuration.

The automatic sear 34 includes an automatic sear disconnector 46 and a leg 48 pivotally mounted on a pin 50. The bottom edge 56 of the automatic sear disconnector 46 is adapted to catch the rear 51 of the hammer 30 and, release the hammer 30 when the top edge 58 of the disconnector 46 is moved by a surface or cut out of the bolt carrier. A spring (not shown) is provided on the pin 50 to bias the bottom end 60 of the leg 48 towards the control cam 36. The control cam 36, at the first section 40, limits axial rotation of the leg 48 on pin 50 in direction 62 (see FIG. 2). The trigger 14 includes a rear portion 52 and is pivotally mounted on a pin 70. The edge 76 of the trigger 14 is adapted to catch the notch 78 of the hammer 30 before the trigger is pulled and, release the, hammer 30 when the trigger 14 is pulled. A spring (not shown) is provided on the pin 70 to bias the leg 52 away from the control cam 36. The control cam 36, at the second section 42 (see FIG. 3), limits axial rotation of the trigger 14 at leg 52 on pin 70 in direction 74 (see FIG. 2). The semi-automatic disconnector 32 includes a rear portion 54 and is pivotally mounted on a pin 70. The edge 72 of the semi-automatic disconnector 32 is adapted to catch the catch 75 of the hammer 30 after the trigger 14 is pulled and, release the hammer 30 when the trigger 14 is released. A spring (not shown) is provided, such as between the trigger and disconnector for example, to bias the leg 54 towards the control cam 36. The control cam 36, at the third section 44, limits axial rotation of the leg 54 on pin 70 in direction 74. FIGS. 1 through 5 and 9 show the firearm 10 with the fire control selector 26 at the "SEMI-AUTOMATIC" position. The fire control selector 26 has a number of selectable fire control positions disposed so that rotation of the selector between a first and last selectable position of the number of selectable positions is less than 180 degrees. The fire control positions of fire control selector 26 include at least safe, semiautomatic and automatic positions. The selectable positions are disposed so that rotation of the fire control selector 26 between at least two adjacent ones of the selectable positions is less than 90 degrees. In the embodiment shown in FIGS. 2 and 5 the positions are disposed for example purposes so that adjacent positions are separated by an arc of about 45 degrees. The rotation of the fire control selector 26 between the first and last selectable positions of the exemplary embodiment in FIGS. 2 and 5 is about 90 degrees.

The fire control selector 26 has a first switch handle 84 protruding from a first side 88 of the receiver 12. In this embodiment, the fire control selector 26 is ambidextrous and also has a second switch handle 82 protruding from an opposite second side 86 of the receiver 12. The second switch handle in this embodiment is removable. In alternate embodiments, the selector may not be ambidextrous, or have a removable handle. The first side 88 of the firearm is indexed with positions 90-94 indicating the positions of the -fire control selector 26. A handle 84 of the fire control selector may have a pointer that points to a given indicated position 90-94 that corresponds with the position of the selector 26. In the embodiment shown, a selectable end position 90 corresponds to a firearm operation mode that is a safe mode (SAFE). Another selectable end position 92 corresponds to a firearm operation mode that is a fully automatic mode (indicated AUTO). An intermediate selectable position 94 of the fire control selector 26 corresponds to a firearm operation mode that is a semiautomatic mode (indicated SEMI). The total rotation of the fire control selector 26 between a safe position, a semiautomatic position and a fully automatic position is about 90 degrees. Rotation of the fire control selector 26 between the safe position and the semiautomatic position is also about 45 degrees. Rotation of the fire control selector 26 between the semiautomatic position and the fully automatic position is about 45 degrees. Similar to the index indicia 90-94 on side 88, the opposite side 86 of the firearm receiver may also have markings (not shown), indicating selector position. In alternate embodiments, the firearm operation mode associated with each of the selectable positions of the fire control selector may be established as desired. For example, the intermediate position may be the SAFE mode, and the AUTO and SEMI modes may be at the fire control selectors end positions.

Figure 6B:
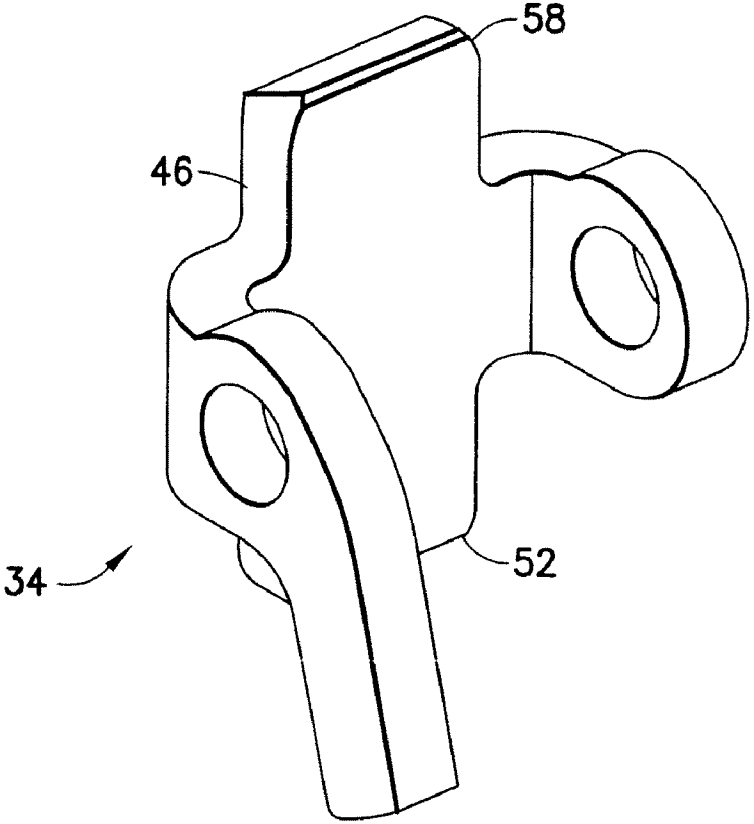
FIG. 6B is an isometric view of an opposite side of the automatic sear shown in FIG. 6A.
Figure 6A:
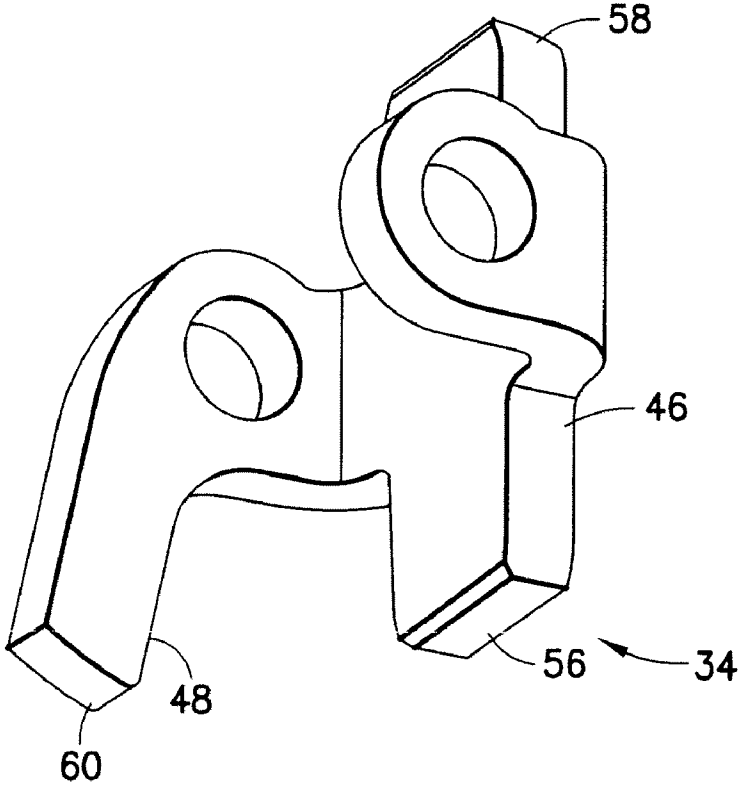
FIG. 6A is an isometric view of an automatic sear of the firearm in FIG. 1.

Referring to FIG. 6A, there is shown an isometric view of an automatic sear 34. Referring also to FIG. 6B, there is shown an isometric view of an opposite side of the automatic sear shown in FIG. 6A. The automatic sear 34 includes a automatic seal disconnector 46 and a leg 48. The disconnector 46 in this embodiment is provided with a clevis or other suitable structure for pivotally mounting the sear 34 on pin 50 (see also FIG. 2). The bottom edge 56 of the disconnector 46 is adapted to catch the rear 51 of the hammer 30, and release the hammer 30 when the top edge 58 of the disconnector 46 is moved by a surface or cut out of the bolt carrier (not shown). The disconnector 46 has a fire control selector engagement leg 48 projecting therefrom. In this embodiment, the leg 48 is substantially straight, extending at a canted angle from the side of the disconnector. In alternate embodiments, the leg may have any other suitable configuration. The bottom end 60 of the leg 48 has a seating surface shaped to ride on the control cam 36. The control cam 36, at the first section 40, limits axial rotation of the leg 48 on pin 50 in direction 62 (see FIG. 2).

Figure 7A:
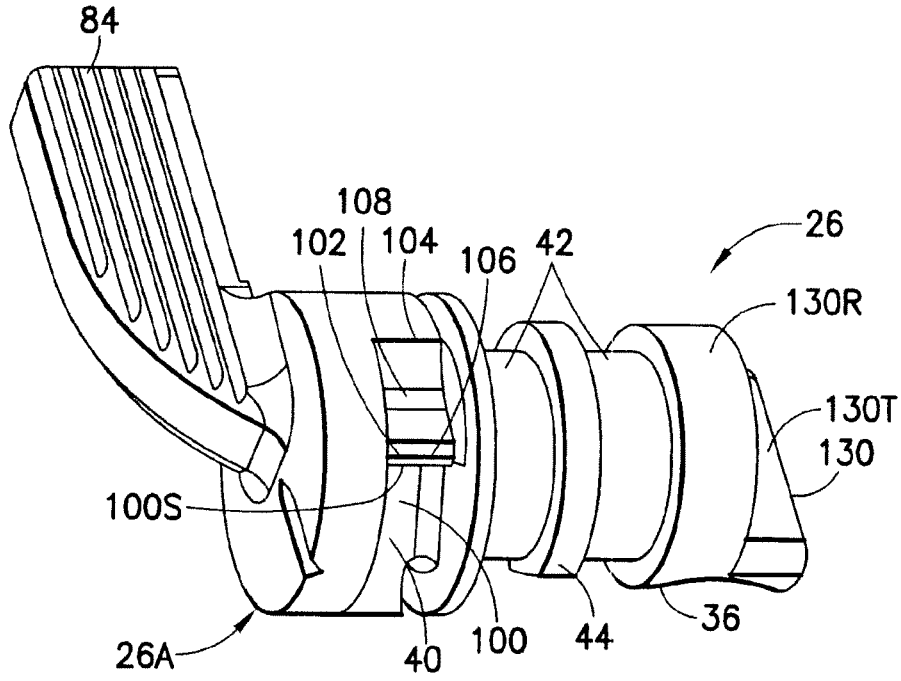
FIG. 7A is an isometric view of a fire control selector of the firearm in FIG. 1.
Figure 7B:
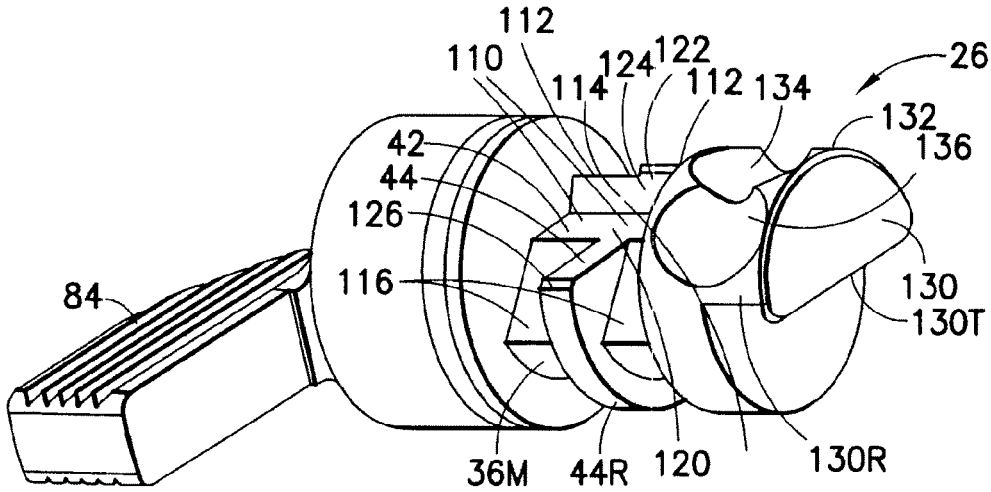
FIG. 7B is an isometric view of an opposite side of the fire control selector shown in FIG. 7A.

Referring to FIG. 7A there is shown an isometric view of a fire control selector 26. Referring also to FIG. 7B, there is shown an isometric view of an opposite side of the fire control selector 26 shown in FIG. 7A. As seen in FIGS. 7A-7B, the fire control selector 26 has a selector portion 26A that may be a one piece member of unitary construction. In this embodiment, the selector portion comprises a cam shaft or cam 36 and a selector handle 84. The fire control selector cam 36 has an automatic sear camming surface 40 and a trigger camming surface 42 disposed adjacent the automatic sear camming surface 40. A disconnect camming surface 44 is disposed adjacent the trigger camming surface 42. In alternate embodiments, the positions of the trigger camming surface, automatic sear camming surface and disconnect camming surface on the cam may be disposed in any other desired positions. Selector portion 26A having cam 36 may be cast of metal with the sections cast therein, however in alternate embodiments such sections or the part itself could be cut or machined in one part out of a billet of material if desired. The automatic sear camming surface 40, the trigger camming surface 42 and the disconnect camming surface 44 are arranged so that, when the selector is installed in a firearm receiver 12, the automatic sear camming surface 40, the trigger camming surface 42 and the disconnect camming surface 44 respectively engage an automatic sear 34, a trigger 14 and a disconnect 32 of the firearm 10 to select a firearm operation mode. Rotation of the fire control selector 26 between a selectable end position, from selectable positions of the fire control selector 26 and another selectable end position is less than 180 degrees. The first section 40 of fire control selector 26 forms an automatic sear control section positioning the auto sear in the safe, semi and automatic positions. This shape is shown generally in FIGS. 7A and 7B. More specifically, as seen best in FIG. 7A, the cross-sectional shape of the first camming surface 40 has a notch or undercut 100 to accept leg 48. The leg 48 of the automatic sear 34 is accepted in the notch 100 when the fire control selector 26 is in a fully automatic position (see FIG. 11C). Notch 100 defines seating surface 100S against which the bottom 60 of the auto sear leg 48 abuts when held in the automatic fire position. First camming surface 40 further has first and second engagement surfaces 102, 104. The leg 48 of the automatic sear 34 contacts the first engagement surface 102 when the fire control selector 26 is in a semiautomatic position. The leg 48 of the automatic sear 34 contacts the second engagement surface 104 when the fire control selector is in a safe position. In this embodiment, engagement surface 102 is formed by an outer lip of notch 100. Radius 106 may be provided on first engagement surface 102 for smooth transition between selections. Recess 108 may be provided between first and second engagement surfaces 102, 104 for smooth transition between selections, and provides conformal seating surface for the leading edge of the bottom 60 of the auto sear leg 48 (see FIG. 6A). As seen best in FIG. 7B, the second camming surface 42 has a land 110, 110 for contacting the trailing leg 15 (see also FIGS. 2-3) of trigger 14 when the fire control selector is in a semiautomatic position. The second camming surface 42 further has a step 112, 112 projecting from the land 110, 110. The step contacts the trailing leg 15 of trigger 14 when the fire control selector 26 is in a safe position as will be described in greater detail below. The land 110, 110 and the step 112, 112 form a notch 114 in the fire control selector 26. The second camming surface 42 has a land 116, 116 for contacting the trailing leg 15 of trigger 14 when the selector 26 is in a fully automatic position. In this embodiment, the land 116 adjoins land 110 of the camming surface 42. Third or disconnect camming surface 44 is defined on a rib 44R projecting from the portion 36M of the cam forming trigger camming surface 42. Camming surface 44 has a land 120 for contacting the disconnect 32 when the fire control selector 26 is in a semiautomatic position. The third camming surface 44 further has a step 122 projecting from the land 120. The step contacts the disconnect 32 when the fire control selector 26 is in a safe position. The land 120 and the step 122 form a notch 124 in the selector 26, which in this embodiment is the same as notch 114. The third camming surface 44 has a land 120 further projecting to tip 126 for contacting the disconnect 32 when the fire control selector 26 is in a fully automatic position. Thus, in this embodiment, the trigger camming surface 42 comprises first and second trigger camming surfaces 110, 110; 112, 112 and 116, 116 disposed on opposite sides of the rib 44R forming disconnect camming surface 44. A switch handle 84 is disposed adjacent the automatic sear camming surface 40 of cam 36. In this exemplary embodiment, the fire control selector 26 is ambidextrous and is hence provided with two handles on opposing sides of the firearm. The fire control selector 26 may be an assembly (in this case comprising selector positions 26A and 82A (see also FIG. 8) as will be described below). As shown in FIGS. 7A-7B, in this embodiment, coupling feature 130 is provided on selector portion 26A to mate with a mating feature of the removable second handle 82 and transmit torque between the second handle and the fire control selector 26 portion. In the embodiment shown, the coupling feature generally comprises a radial seating surface 130R and a torque transfer feature 130T. In this example, the torque transfer feature is generally D-shaped. In alternate embodiments, any suitable coupling could be employed. In still other alternate embodiments, the fire control selector may not be provided with a coupling for mating opposing handles. As seen best in FIG. 7B, the cam 36 of selector portion 26A may also include three recesses 132, 134, 136 providing the fire control selector 26 with an indexer for holding the fire control selector in each selector position (e.g. SAFE, SEMI, AUTO). The three recesses 132, 134, 136 are adapted to be engaged by a moveable plunger 138 (see FIG. 9) of the firearm 10 for holding the fire control selector 26 in each selectable position. In this embodiment, the index recesses 132, 134, 136 are shown as being generally rounded/conical to complement a rounded/conical plunger. In alternate embodiments, the selector indexer may have any other desired shape. The recesses 132, 134, 136 are located around circumference 130R to coincide with the selector position when in SAFE, SEMI and AUTO modes. Hence, the circumferential pitch between adjacent recesses is the same as the rotational separation between selector positions. Further, in this embodiment, the recesses 132, 134, 136 indexing the fire control selector 26 are located in the locating surface 130R of the coupling 130.

Figure 8:
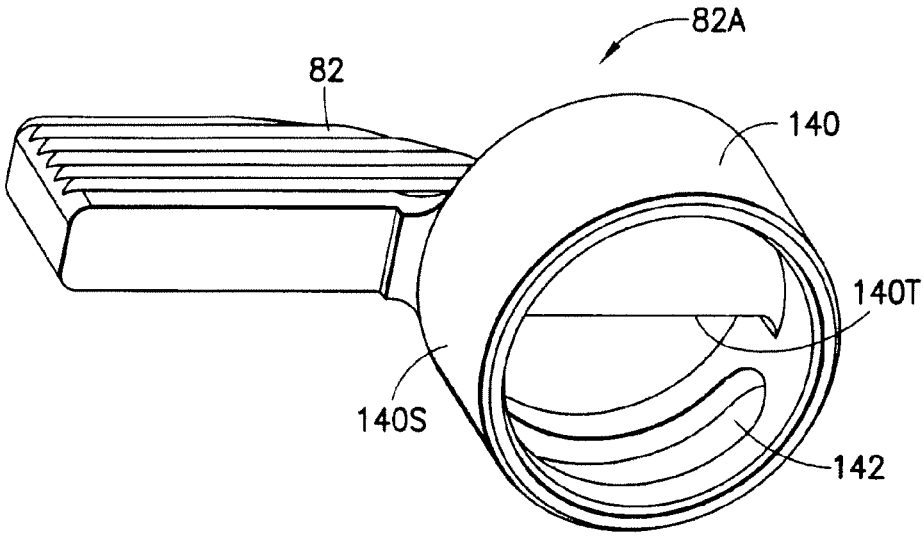
FIG. 8 is an isometric view of a fire control selector handle of the firearm in FIG. 1.
Figure 9:
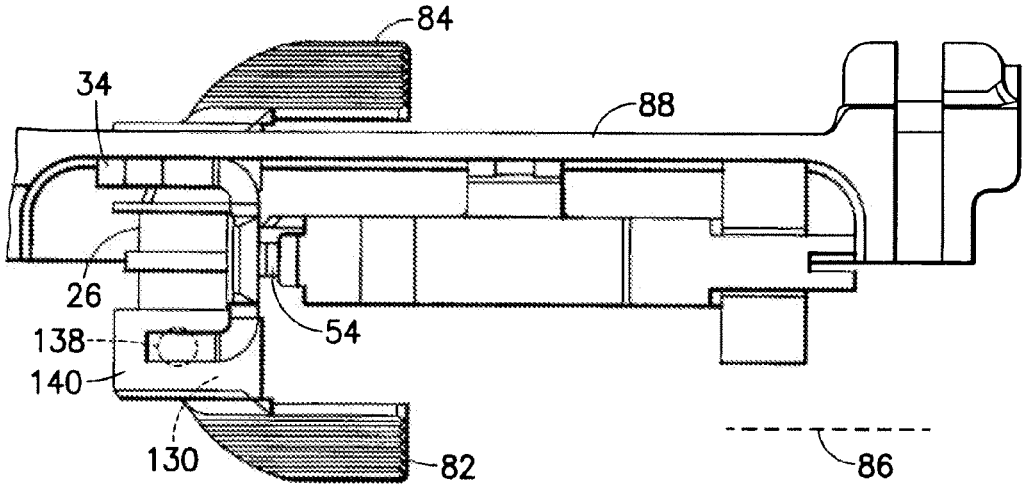
FIG. 9 is a partial top elevation view, partially in section of the receiver section of the firearm shown in FIG. 1.

Referring to FIG. 8, there is shown an isometric view of another portion 82A of fire control selector 26. Referring also to FIG. 9. there is shown a partial top elevation view, partially in section of the receiver section of the firearm shown in FIG. 1. In the embodiment shown, the fire control selector 26 has a second selector portion with switch handle 82 protruding from the second side 86 of the receiver 12 and first switch handle 84 protruding from an opposite side 88 of the receiver. The selector portion 82A may be a one piece member of unitary construction cast or machined as desired. The selector portion 82A may include handle 82 and a coupling section 140 enabling the selector portion 82A to be removably mounted to selector portion 26A. The coupling section, for example, may have an outer cup 140S shaped to be seated against the locating surface 130R (see FIG. 7B) of selector portion 26A. The coupling 140 may also have a torque transfer feature 140T, in this case having a generally D-shaped mating feature and a slot 142. Slot 142 is sized to allow plunger 138 to pass through the slot. The mating feature of selector portion 82A engages the coupling feature 130 of the fire control selector portion 26A. When mounted to the receiver, the first fire control selector portion 26A protrudes from the first side 88 of the receiver and the second fire control selector 82A protrudes from the second side of the receiver 86. The, couplings 130, 140 of the first and second selector portions 26A, 82A are removably mated, cup 140S receiving the locating surface 130R, and the torque transfer features 130T, 140T abutting one another. Plunger 138 is spring loaded and enters through slot 142 in coupling 140 to engage a recess 132-136 in the coupling 130. Thus, plunger 138 provides a positive latching means holding the second selector portion 82A to the first selector portion 26A. The spring loaded plunger 138 also acts as an indexer stably holding the mode selector 26 in each of the selectable positions with the indexer having, as noted before, indexing positions corresponding to the selectable positions and being located so that selector rotation between an end one of the selectable positions and another end one of the selectable positions is less than about 180 degrees. The plunger 138 may be mounted to receiver 12 and engages at least one recess 132, 134, 136 (through the slot 142). The coupling feature 130T, 140T transfers torque between the first fire control selector portion 26A and the second fire control selector portion 82A. Accordingly, an operator may position the fire control selector 26 as desired using the handles 84; 82 on either portion of the selector. Removal of the second selector portion 82A from the receiver 12 may be readily effected by merely withdrawing the second selector portion from the receiver which depresses the plunger to automatically disengage the two portions of the selector. Engagement of the second selector portion 82A is performed substantially in the reverse manner by merely inserting the selector portion 82A coupling first into the receiver, the plunger 138 automatically engaging through slot 142 to lock the second selector 82A to the first selector 26A.

Figure 10A:
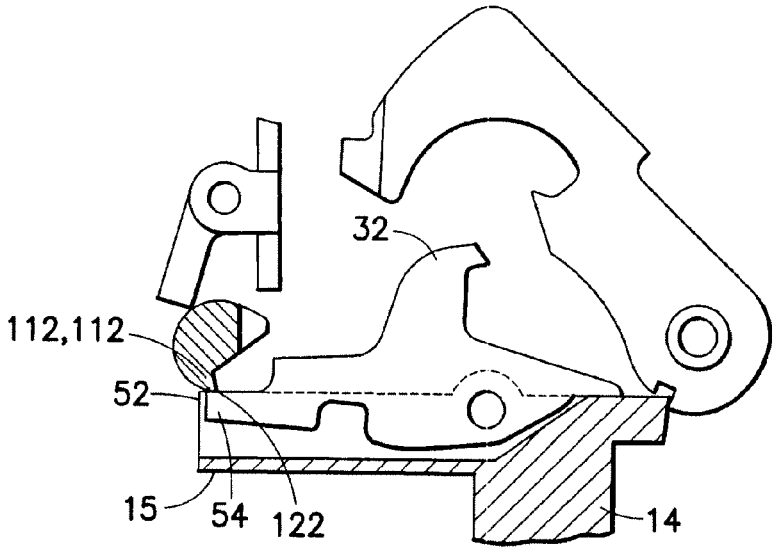
FIG. 10A is a partial side elevation view, partially in section of the firearm shown in FIG. 1 with the fire control selector in a safe position.
Figure 10B:
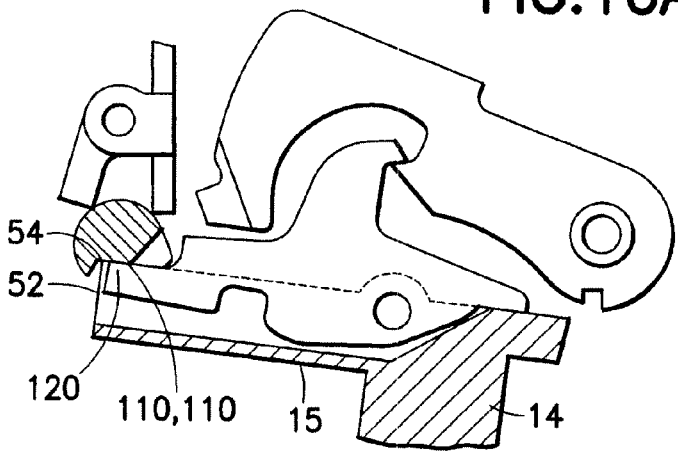
FIG. 10B is a partial side elevation view, partially in section of the firearm shown in FIG. 1 with the fire control selector in a semiautomatic position.
Figure 10C:
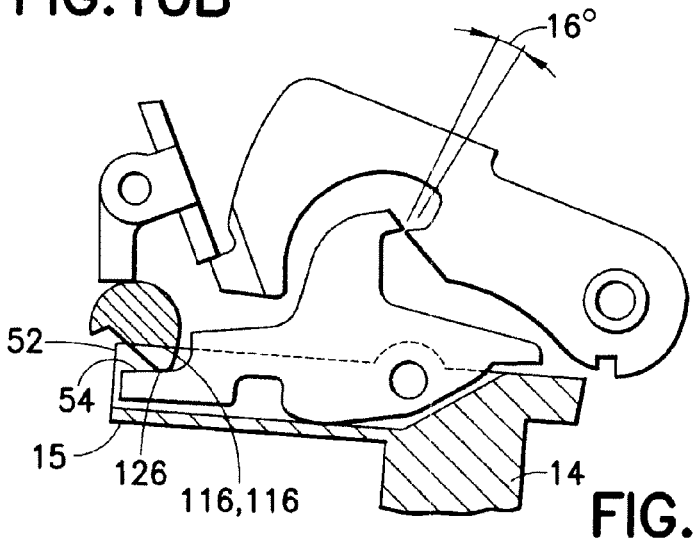
FIG. 10C is a partial side elevation view, partially in section of the firearm shown in FIG. 1 with the fire control selector in a fully automatic position.
Figure 11C:
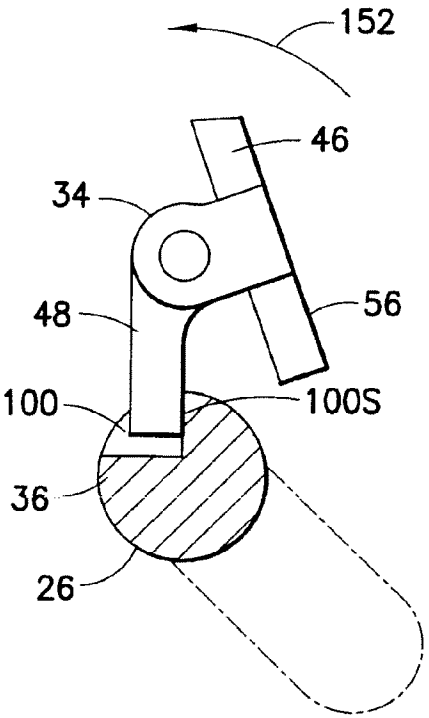
FIG. 11C is a partial side elevation view, partially in section of the firearm shown in FIG. 1 with the fire control selector and automatic sear in a fully automatic position.

Referring to FIG. 10A, there is shown a partial side elevation view, partially in section of the firearm shown in FIG. 1 with the fire control selector 26 in a safe position. Referring also to FIG. 10B, there is shown a partial side elevation view, partially in section of the firearm shown in FIG. 1 with the fire control selector 26 in a semiautomatic position. Referring also to FIG. 10C, there is shown a partial side elevation view, partially in section of the firearm shown in FIG. 1 with the fire control selector 26 in a fully automatic position. With the fire control selector in the "SAFE" position shown in FIG. 10A, end 52 on member 15 of trigger 14 contacts the surfaces 112, 112 of fire control selector 26 and end 54 of disconnect 32 contacts surface 122 of fire control selector 26. This limits the rotation of the trigger, which locks the main sear 76 on the trigger in position engaging catch 78 of the hammer 30. In this position, the trigger can not be pulled sufficiently to release hammer 30. When the fire control selector 26 is rotated to the "SEMI" setting, the control cam 36 is rotated to the position shown in FIG. 10B. In this position the end 52 of trigger 14 contacts the surfaces 110, 110 of fire control selector 26 and end 54 of disconnect 32 contacts surface 120 of the fire control selector 26. Thus, control cam 36 allows the trigger to be pulled to release hammer 30 and also allows disconnect 32 to engage hammer 30 after the trigger has been pulled as shown such that the disconnect 32 is operable. When the fire control selector 26 is rotated to the "FULL AUTO" setting, the control cam 36 is rotated to the position shown in FIG. 10C. In this position the end 52 of trigger 14 contacts the surfaces 116, 116 of fire control selector 26 and end 54 of disconnect 32 contacts surface 126 of fire control selector 26. Thus, the control cam 36 allows the trigger to be pulled to release hammer 30 but does not allow disconnect 32 to engage hammer 30 after the trigger has been pulled as shown due to gap 160 such that the disconnect 32 is in operable. As shown in FIG. 11C, the leg 48 of the automatic sear 34 contacts the cam 36 of fire control selector 26 in the notch 100 allowing it to rotate further in direction 152, thus allowing the bottom 56 of the automatic sear to interact with the rear of the hammer 30 at notch 51 facilitating fully automatic operation until the trigger is released. The control cam 36 can be rotated clockwise and counterclockwise to move from firing selections including safe, semi-automatic, fully automatic and back to safe or, from safe to fully automatic, to semi-automatic and back to safe.

Figure 11B:
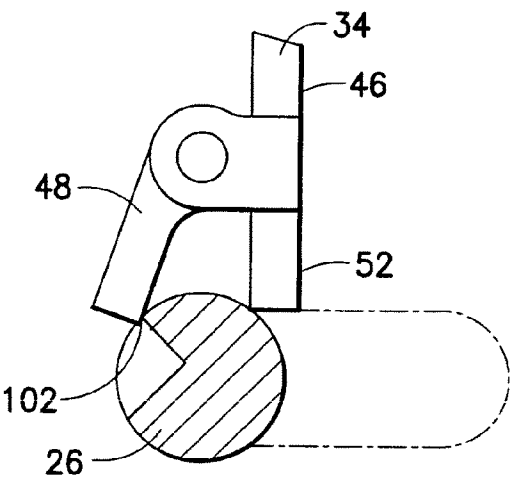
FIG. 11B is a partial side elevation view, partially in section of the firearm shown in FIG. 1 with the fire control selector and automatic sear in a semiautomatic position.
Figure 11A:
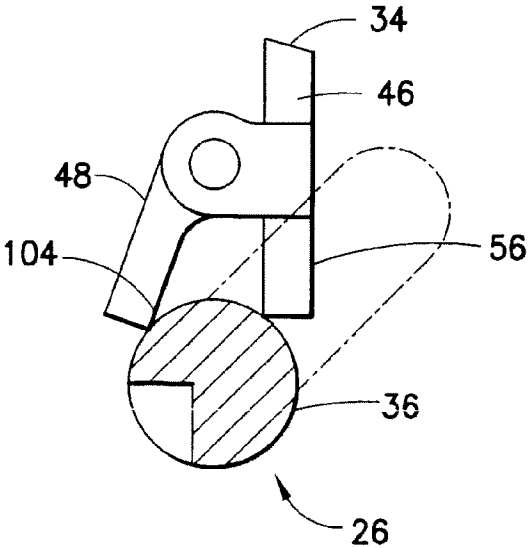
FIG. 11A is a partial side elevation view, partially in section of the firearm shown in FIG. 1 with the fire control selector and automatic sear in a safe position.

Referring to, FIG. 11A, there is shown a partial side elevation view, partially in section of the firearm shown in FIG. 1 with the fire control selector 26 in a safe position. Referring also to FIG. 11B, there is shown a partial side elevation view, partially in section of the firearm shown in FIG. 1 with the fire control selector in a semiautomatic position. Referring also to FIG. 11C, there is shown a partial side elevation view, partially in section of the firearm shown in FIG. 1 with the fire control selector 26 in a fully automatic position. With the fire control selector 26 in the "SAFE" position shown in FIG. 11A, leg 48 of the automatic sear 34 contacts the surface 104 of fire control selector 26. This limits the position of the leg 48 which, in turn, limits the position of the automatic sear disconnector 46 to the substantially vertical position shown. The bottom 56 of the automatic sear disconnector 46 is too far back to interact with the rear of the hammer 30. When the fire control selector 26 is rotated to the "SEMI" setting, the control cam 36 is rotated to the-position shown in FIG. 11B. In this position the curved surface 102 of the fire control selector 26 still contacts the tip of leg 48 of the automatic sear 34. Thus, the control cam 36 still limits the position of the leg 48 to limit the position of the automatic sear disconnector 46 to the inoperative substantially vertical position shown. When the fire control selector switch 26 is rotated to the "FULL AUTO" setting, the control cam 36 is rotated to the position shown in FIG. 11C. In this position the leg 48's of the automatic sear 34 bottom end 60 is in the same position shown in FIG. 11C. The leg 48 of the automatic sear 34 contacts the cam 36 in the notch 100 of fire control selector 26 allowing it to rotate further in direction 152, thus allowing the bottom 56 of the automatic sear disconnector 46 to interact with the rear of the hammer 30. When the fire control 26 is rotated back to the "SAFE" position of FIG. 11A, the notch/step 100-102-104 pushes the leg backward in a direction reverse to direction 152. The control cam 36 can be rotated clockwise and counterclockwise to move from firing selections including safe, semi-automatic, fully automatic and back to safe or, from safe to fully automatic, to semi-automatic and back to safe.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An automatic firearm capable of automatic or semiautomatic fire comprising:

a receiver having a moveable hammer located therein;

a selector rotatably mounted in the receiver, the selector having at least one camming surface arranged for camming engagement with a automatic sear, the automatic sear contacting the at least one camming surface and rotatably mounted in the receiver to engage the hammer, a second sear, rotatably mounted in the receiver to engage the hammer, and a disconnect rotatably mounted in the receiver, wherein, the selector has a number of selectable positions, at least one selectable position of which corresponds to the at least one camming surface being in camming engagement with the automatic sear, the at least one camming surface being arranged for camming engagement with the second sear and disconnect and disposed relative to the automatic sear, second sear and disconnect so that rotation of the selector between a first and last selectable position of the number of selectable positions is less than 180 degrees.

2. The automatic firearm of claim 1, wherein the second sear is formed on the trigger.

3. The automatic firearm of claim 1, wherein the selectable positions are fire control positions.

4. The automatic firearm of claim 3, wherein the fire control positions includes at least safe, semiautomatic and automatic positions.

5. The automatic firearm of claim 1, wherein the selectable positions are disposed so that rotation of the selector between at least two adjacent ones of the selectable positions is 45 degrees.

6. The automatic firearm of claim 1, wherein the rotation of the selector between the first and last selectable positions is 90 degrees.

7. The automatic firearm of claim 1, wherein the selector further comprises a first switch handle protruding from a first side of the receiver and a second switch handle protruding from an opposite second side of the receiver.

8. The automatic firearm of claim 2, wherein the at least one camming surface has a land contacting the second sear when the selector is in a semiautomatic position, and wherein the at least one camming surface further has a step projecting radially from the land, the step contacting the second sear when the selector is in a safe position.

9. The automatic firearm of claim 8, wherein the land and the step form a notch in the selector.

10. The automatic firearm of claim 1, wherein the at least one camming surface has a notch and wherein a leg of the automatic sear is accepted in the notch when the selector is in a fully automatic position.

11. The automatic firearm of claim 10, wherein the at least one camming surface has first and second engagement surfaces and wherein the leg of the automatic sear contacts the first engagement surface when the selector is in a semiautomatic position and wherein the leg of the automatic sear contacts the second engagement surface when the selector is in a safe position.

12. The automatic firearm of claim 1 wherein:

the selector has an ambidextrous selector assembly adapted to be rotatably mounted in the receiver, the receiver having first and second opposing sides, the ambidextrous selector assembly comprising:

a first fire control selector, with the at least one camming surface therein, and having a switch handle, and a coupling feature and at least one recess adapted to be engaged by a moveable plunger of the firearm for holding the first fire control selector in a selectable position; and a second fire control selector having a switch handle, a mating feature and a slot;

wherein, the mating feature in the second fire control selector engages the coupling feature of the first fire control selector, wherein, when mounted to the receiver, the first fire control selector protrudes from the first side of the receiver and the second fire control selector protrudes from the second side of the receiver, and wherein the plunger engages the at least one recess through the slot.

13. The automatic firearm of claim 12, wherein the coupling feature has a torque transfer feature.

14. The automatic firearm of claim 12, wherein the selector assembly is capable of rotation between a safe position, a semiautomatic position and a fully automatic position, and wherein rotation between the safe position and the fully automatic position is less than 180 degrees.

15. The automatic firearm of claim 12, wherein the selector assembly is capable of rotation between a safe position, a semiautomatic position and a fully automatic position, and wherein rotation between the safe position and the fully automatic position is about 90 degrees.

16. The automatic firearm of claim 12, wherein the at least one camming surface comprises a trigger camming surface having a land contacting a trigger when the selector assembly is in a semiautomatic position, and wherein the trigger camming surface further has a step projecting from the land, the step contacting the trigger when the fire control selector is in a safe position, and wherein the land and the step form a notch in the camming surface.

17. The automatic firearm of claim 12 wherein the at least one camming surface comprises a sear camming surface having a notch and wherein a leg of an automatic sear is accepted in the notch when the selector assembly is in a fully automatic position, and wherein the sear camming surface has first and second engagement surfaces, and wherein the leg of the automatic sear contacts the first engagement surface when the selector assembly is in a semiautomatic position, and wherein the leg of the automatic sear contacts the second engagement surface when the selector assembly is in a safe position.

18. The automatic firearm of claim 12, wherein the moveable plunger locks the first fire control selector and the second fire control selector together.

19. The automatic firearm of claim 12, wherein the coupling feature transfers torque between the first fire control selector and the second fire control selector.

* * * * *